US008221191B2

(12) United States Patent
Matsuzaki

(10) Patent No.: US 8,221,191 B2
(45) Date of Patent: Jul. 17, 2012

(54) CMP APPARATUS AND METHOD OF POLISHING WAFER USING CMP

(75) Inventor: Toru Matsuzaki, Tokyo (JP)

(73) Assignee: Elpida Memory, Inc., Tokyo (JP)

( * ) Notice: Subject to any disclaimer, the term of this patent is extended or adjusted under 35 U.S.C. 154(b) by 688 days.

(21) Appl. No.: 12/182,565

(22) Filed: Jul. 30, 2008

(65) Prior Publication Data

US 2009/0036024 A1 Feb. 5, 2009

(30) Foreign Application Priority Data

Jul. 30, 2007 (JP) ..... 2007-197703

(51) Int. Cl.
*B24B 51/00* (2006.01)

(52) U.S. Cl. ..... 451/5; 451/21; 451/56

(58) Field of Classification Search ..... 451/5, 21, 451/443, 444, 56, 72, 41, 57
See application file for complete search history.

(56) References Cited

U.S. PATENT DOCUMENTS

| | | | | |
|---|---|---|---|---|
| 6,045,434 | A * | 4/2000 | Fisher et al. | 451/6 |
| 6,602,436 | B2 * | 8/2003 | Mandigo et al. | 216/88 |
| 7,306,506 | B2 * | 12/2007 | Elledge | 451/5 |
| 2008/0242195 | A1 * | 10/2008 | Heinrich et al. | 451/6 |

FOREIGN PATENT DOCUMENTS

WO WO 02/087825 11/2002

* cited by examiner

*Primary Examiner* — Robert Rose
(74) *Attorney, Agent, or Firm* — Young & Thompson

(57) ABSTRACT

A CMP apparatus is provided with a polishing pad, a film thickness sensor for measuring a thickness of a film being polished on a wafer via the polishing pad, a polishing pad thickness measuring unit for measuring the thickness of the polishing pad, a dresser for dressing the polishing pad, and a polishing control unit for switching polishing conditions in response to a fact that an output value from the film thickness sensor has exceeded a threshold value. The polishing control unit has a memory unit for storing a threshold value corresponding to the thickness of the polishing pad after dressing when the polishing pad is dressed.

20 Claims, 3 Drawing Sheets

CMP APPARATUS AND METHOD OF POLISHING WAFER USING CMP

TECHNICAL FIELD

The present invention relates to a CMP (chemical mechanical polishing) apparatus and a method of polishing a semiconductor wafer using the CMP, and more particularly relates to a method for detecting timing for switching polishing speed.

BACKGROUND OF THE INVENTION

CMP is an important technique in manufacturing semiconductor devices. Semiconductor integrated circuit chips are manufactured by forming conductive layers, insulating layers, or other thin film layers in a prescribed order on a wafer, patterning the layers depending on need by photolithography and etching, and cutting and separating each chip on the wafer after forming all layers. When there are convexities and concavities or steps in the substrate when a film is formed, the thickness of the film formed on the substrate will be thin in parts and step coverage will worsen, causing lower yield and other problems. Also, problems occur in that focus during exposure is not fixed and precise patterns cannot be transferred because convexities and concavities appear in upper layers due to the effect of the lower patterned layers. For this reason, the surface of the film material must be planarized, and CMP is used for such a purpose.

In CMP, efforts are made to increase throughput (the number of wafers that can be polished in a unit of time) by polishing at the maximum possible speed. However, when tungsten (W), copper (Cu), titanium nitride (TiN) or another metal film is polished at high speed, there is a problem in that erosion increases. Therefore, in metal-based CMP, high-speed polishing is performed first, and at the point when the thickness of the metal film reaches around several tens of nanometers, by switching from high-speed polishing to low-speed polishing. As a result, erosion is reduced.

A method is known in which an eddy current sensor is used as one method for measuring the thickness of a metal film during high-speed polishing (Japanese Laid-open Patent Publication No. 2004-525521). The eddy current sensor measures the thickness of a metallic film by using a high-frequency magnetic field. Therefore, the metal film is polished at high speed while the film thickness is measured using the eddy current sensor, high-speed polishing is terminated when the eddy current sensor reaches a prescribed threshold value, and a switch is made to low-speed polishing.

However, when the thickness of the polishing pad changes due to polishing pad wear, the remaining metal film will also have a thickness that corresponds to the variations in the polishing pad thickness. When the polishing pad thickness fluctuates due to polishing pad wear, the remaining metal film will also have a thickness that corresponds to the fluctuations in the polishing pad thickness. Since the distance to the metal film being polished increases when the polishing pad is thick, the thickness of the metal film becomes greater than the target thickness, even when high-speed polishing has ended at the point when the eddy current sensor has reached a prescribed output value. Also, since the distance to the metal film being polished is reduced when the polishing pad is thin, the thickness of the metal film is less than the target thickness, even when high-speed polishing has ended at the point when the eddy current sensor has reached a prescribed output value. Variations in the remaining metal film lead to variations in the polishing time in low-speed polishing (barrier clear polishing) that follows, and the remaining film also is thick when the polishing pad is thick. Therefore, there is a problem in that CMP throughput is reduced. When the polishing pad is thick, the remaining film will also be thick. Since the remaining film becomes thin when the polishing pad is thin, quality degradation is liable to occur due to erosion and the like.

SUMMARY OF THE INVENTION

It is therefore an object of the present invention to provide a CMP apparatus and a wafer polishing method using CMP in which a film being polished on a wafer can be set to a constant thickness during high-speed polishing even if the thickness of the polishing pad changes due to polishing pad wear.

The above and other objects of the present invention can be accomplished by a CMP apparatus for polishing a film on a wafer that comprises a polishing pad; a film thickness sensor for measuring the thickness of the film via the polishing pad; a polishing pad thickness measuring unit for measuring a thickness of the polishing pad; a dresser for dressing the polishing pad; and a polishing control unit for switching polishing conditions in response to that fact that an output value from the film thickness sensor has exceeded a threshold value, wherein the polishing control unit has a memory unit for storing the threshold value corresponding to the thickness of the polishing pad after dressing when the polishing pad is dressed.

It is preferable in the present invention that the memory unit further store conversion information that shows the relationship between the output value of the film thickness sensor and the thickness of the polishing pad when the thickness of the film being polished is constant, and that the polishing control unit accesses the conversion information, obtains the output value of the film thickness sensor that corresponds to the thickness of the polishing pad after dressing, and records the output value as the threshold value.

It is preferable in the present invention that the polishing pad thickness measuring unit includes a pad probe, and that the film thickness sensor includes an eddy current sensor. It is further preferable that the polishing target is a metal film or a metal compound film.

The above and other objects of the present invention can also be accomplished by a wafer polishing method using CMP, comprising a polishing pad dressing step for dressing a polishing pad; a threshold value recording step for recording a threshold value that has been corrected based on a thickness of the polishing pad after dressing; a high-speed polishing step setting a wafer to be polished and performing high-speed polishing while a thickness of a film being polished is monitored using a film thickness sensor; a polishing condition switching step for switching from high-speed polishing to low-speed polishing when an output of the film thickness sensor reaches the threshold value; and a low-speed polishing step for performing low-speed polishing of the wafer as far as the polishing terminal point.

It is preferable in the present invention that the threshold value recording step include a step for accessing conversion information that shows a relationship between the output value of the film thickness sensor and the thickness of the polishing pad when the thickness of the film being polished is constant, and obtaining the output value of the film thickness sensor that corresponds to the thickness of the polishing pad after dressing; and a step for recording the output value as the threshold value.

In this way, according to the present invention, the timing for switching the polishing conditions in metal-based CMP can be precisely measured, and throughput improvement and erosion prevention can be assured because a threshold value of an eddy current sensor can be corrected in accordance with the thickness of the polishing pad.

BRIEF DESCRIPTION OF THE DRAWINGS

The above and other objects, features and advantages of this invention will become more apparent by reference to the following detailed description of the invention taken in conjunction with the accompanying drawings, wherein.

DETAILED DESCRIPTION OF THE EMBODIMENTS

Preferred embodiments of the present invention will be described hereinafter with reference to the accompanying diagrams.

Figure 1:
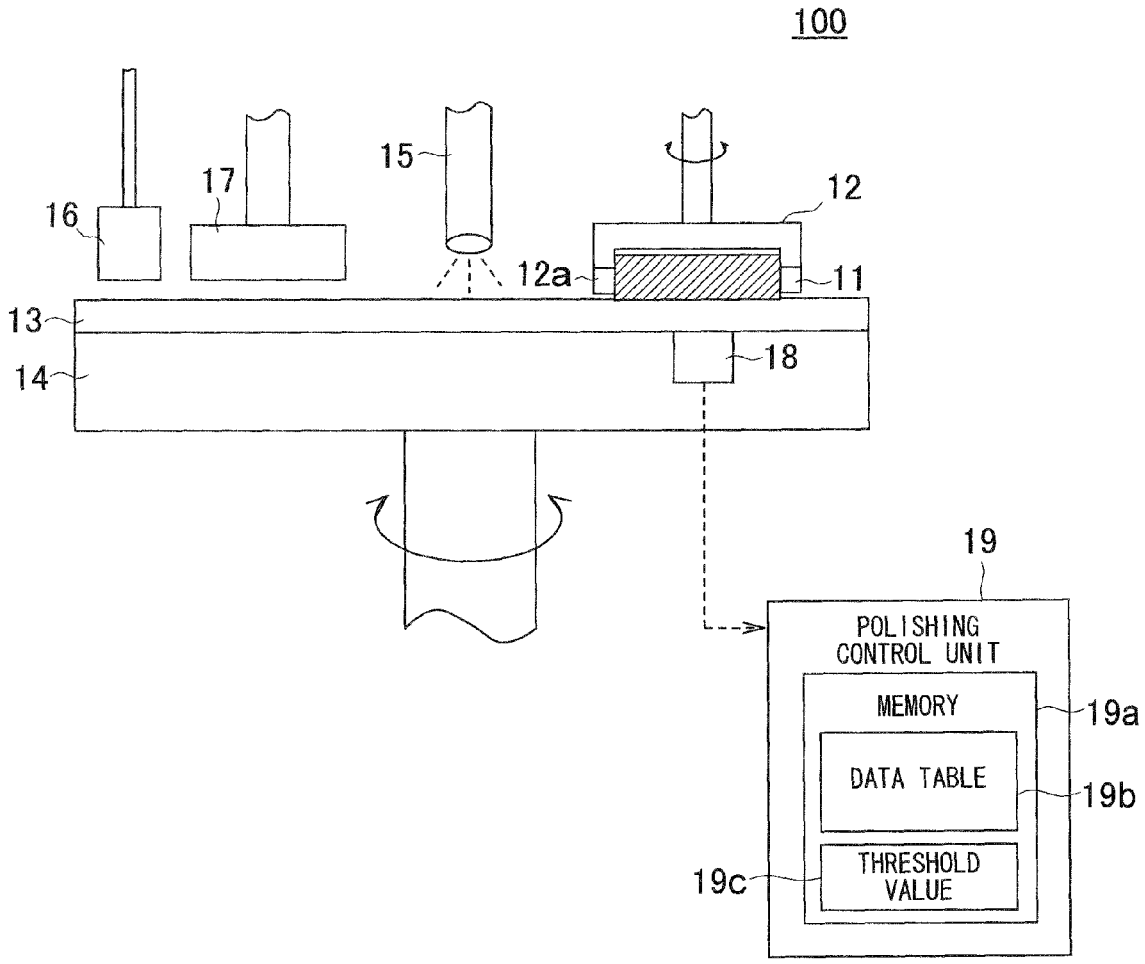
FIG. 1 is a schematic view showing a configuration of a CMP apparatus according to a preferred embodiment of the present invention.

FIG. 1 is a schematic view showing a configuration of a CMP apparatus according to a preferred embodiment of the present invention.

As shown in FIG. 1, the CMP apparatus 100 is provided with a polishing head 12 for holding a wafer 11, a rotary surface plate 14 on which a polishing pad 13 is mounted, a slurry supply unit 15 for supplying a slurry that contains silica ($SiO_2$) microparticles or another abrasive, a pad probe 16 for measuring the state of a polishing pad 13, a dresser 17 for dressing the polishing pad 13, an eddy current sensor 18 for measuring the thickness of a tungsten film, which is the metal film being polished on the wafer 11, and a polishing control unit 19 that controls these components.

The polishing head 12 is provided with a spindle mechanism for rotating the wafer 11, and a pressing mechanism for pressing the wafer 11 against the polishing pad 13 using an optimal pressure. A guide ring 12*a* is provided at the external periphery of the wafer 11 that is set in the polishing head 12, whereby the wafer 11 can be reliably held in place. The rotary surface plate 14 is also provided with a spindle mechanism for rotating the polishing pad 13. The wafer 11 and the polishing pad 13 can thereby be moved relative to each other, and uniform polishing can be efficiently performed.

The polishing pad 13 is attached to the main surface of the rotary surface plate 14. The polishing pad 13 is composed of a two-layer structure of a cushion sheet and a polishing sheet having a microporous structure. Rigid polyurethane foam is used as the polishing sheet. The polishing pad 13 is a consumable article. The polishing surface of the polishing pad 13 is restored by performing periodic dressing using a dresser 17, but a polishing pad 13 that has been entirely worn is removed from the rotary surface plate 14 and replaced with a new polishing pad.

The pad probe 16 detects the service life of the polishing pad 13, the terminal point of the dressing, and processing abnormalities by monitoring the friction coefficient of the surface of the polishing pad 13. The pad probe 16 measures the relative thickness of the polishing pad 13, i.e., the percentage of the current thickness of the polishing pad in relation to the initial thickness of the polishing pad.

The dresser 17 is used for dressing the polishing pad 13 when the friction coefficient has been reduced due to clogging and the like. Diamond grains are embedded in a contact surface with the polishing pad 13, and the surface of the polishing pad 13 is cut by the diamond grains.

The eddy current sensor 18 measures the thickness of a metal film by using a high frequency magnetic field, and is disposed in the vicinity of the main surface of the rotary surface plate 14. An output signal of the eddy current sensor 18 is supplied to a polishing control unit 19, and is used in determining the timing for switching the polishing conditions.

The polishing control unit 19 controls the polishing head 12, the rotary surface plate 14, the slurry supply unit 15, and the like, and more specifically controls the position and rotating speed of the polishing head 12, the rotating speed of the rotary surface plate 14, the amount of slurry supplied from the slurry supply unit 15, and other parameters.

A data table 19*b* is recorded in a memory 19*a* inside the polishing control unit 19. The data table 19*b* shows the relationship between the thickness of the polishing pad 13 when the thickness of a tungsten film is constant (e.g., 20 nm) and the output value of the eddy current sensor 18. The eddy current sensor 18 faces the wafer 11 via the polishing pad 13. The output of the eddy current sensor 18 changes depending on the thickness of the polishing pad 13 because the distance from the eddy current sensor 18 to the polishing surface of the wafer 11 also changes in accordance with the thickness of the polishing pad 13. For example, when variability in the thickness of the polishing pad 13 according to the specifications is ±0.25 mm, a variability of ±15 nm will also occur in the thickness of the tungsten film. Ordinarily, the thickness of the remaining tungsten film that is used in determining the switching timing is set to 10 to 30 nm, and when the thickness of the remaining tungsten film is set to 20 nm, the thickness of the remaining tungsten film will be 20±15 nm, i.e., the thickness of the film will be a maximum of 35 nm and a minimum of 5 nm depending on the variability in the thickness of the polishing pad 13.

In this way, the thickness of the tungsten film after polishing has been stopped will vary depending on whether the polishing pad 13 is relatively thick or relatively thin, even when polishing terminates at a point when the output of the eddy current sensor 18 reaches a prescribed value. However, it is possible to make the tungsten film thickness constant by accessing the data table 19*b* and correcting the threshold value of the film thickness without being affected by changes in the thickness of the polishing pad. Accordingly, a switching timing from high-speed polishing to low-speed polishing can be determined with a high degree of precision. In this way, the threshold value 19*c* of the tungsten film thickness thus obtained is also recorded in memory 19*a*.

Figure 2:
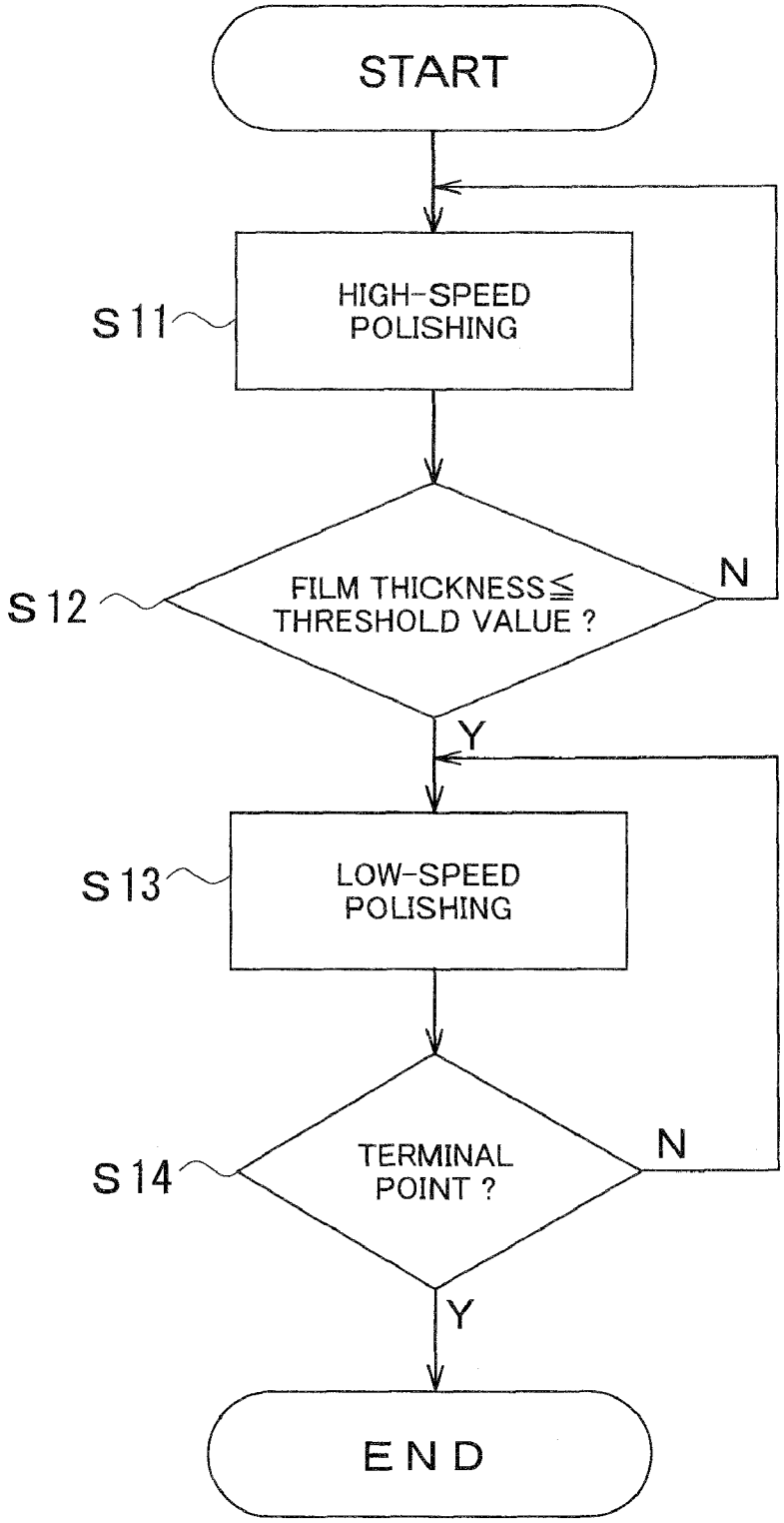
FIG. 2 is a flowchart showing a method for polishing a wafer using a CMP apparatus.

FIG. 2 is a flowchart showing a method for polishing a wafer 11 using a CMP apparatus 100.

As shown in FIG. 2, in the polishing of the wafer 11 according to the present embodiment, first, the processing surface of the wafer 11 is made to face downward and is set in the polishing head 12, the wafer 11 is pressed against the polishing pad 13 while slurry is provided, and high-speed polishing of the wafer 11 is performed (S11) by rotating the wafer 11 and the polishing head 13 at high speed. Afterward, high-speed polishing ends (S12Y) when the thickness of the tungsten film has reached around several tens of nanometers, and a switch is made to low-speed polishing (S13). When the polishing terminal point is detected, the polishing of wafer 11 is terminated (S14Y).

As described above, the thickness of the tungsten film is measured using the eddy current sensor 18, but changes in the thickness of the polishing pad 13 due to dressing produces variability in the thickness of the tungsten film when high-speed polishing terminates. Accordingly, when the polishing pad 13 has been dressed, the threshold value used for determining switching timing of polishing conditions is reset.

Figure 3:
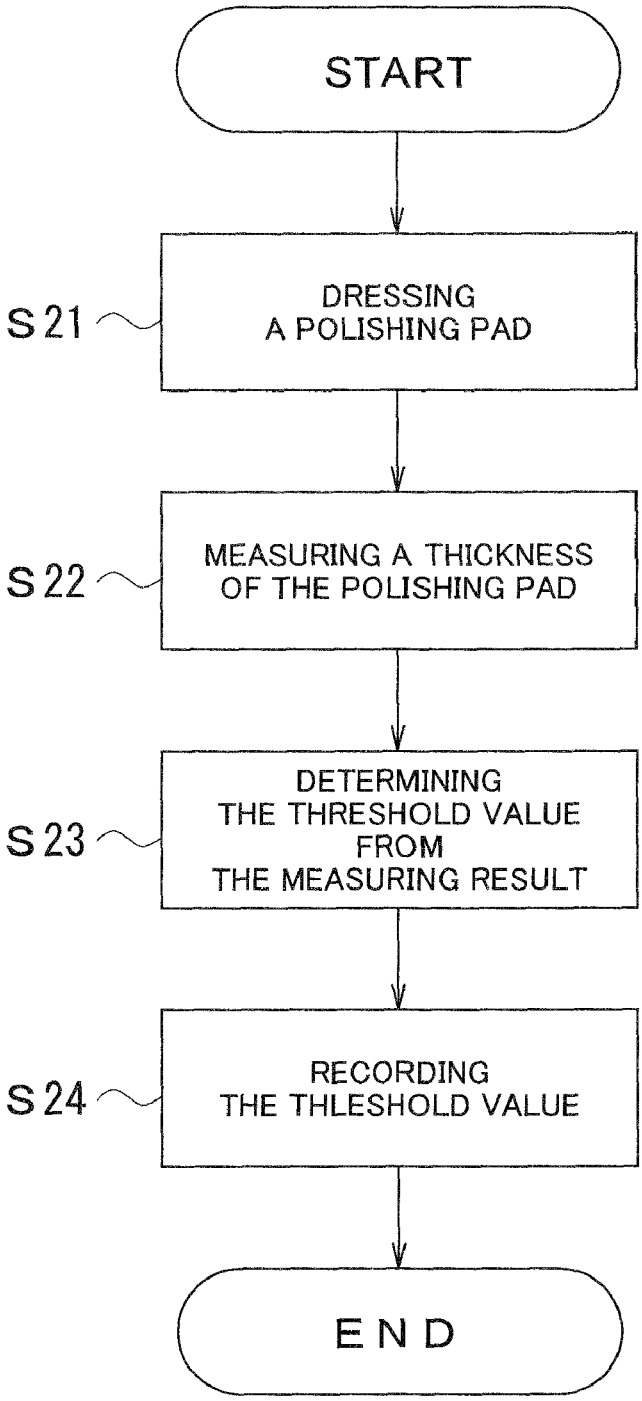
FIG. 3 is a flowchart showing an example of procedures to reset the threshold value.

FIG. 3 is a flowchart showing an example of the procedure for resetting the threshold value.

As shown in FIG. 3, in resetting the threshold value, the polishing pad 13 is first dressed (S21) using the dresser 17. At this point, the threshold value corresponding to the thickness of the polishing pad 13 must be reset because the polishing pad 13 after dressing is thinner than before dressing.

Next, the thickness of the polishing pad 13 after dressing is measured (S22). The thickness can be measured using the pad probe 16, and the measurement results are inputted to the polishing control unit 19.

Next, the polishing control unit 19 accesses the data table 19*b*, and determines the threshold value corresponding to the thickness of the polishing pad 13 (S23). As described above, the relationship between the output value of the eddy current sensor 18 and the thickness of the polishing pad 13 when the thickness of the tungsten film is set as a threshold value for switching the timing of polishing conditions is recorded in data table 19*b*.

Next, the threshold value obtained in this manner is recorded (S24). Afterward, the wafer 11, which is the polishing target, is polished using the threshold value. In other words, the wafer 11 undergoes high-speed polishing until the output of the eddy current sensor reaches the threshold value. A switch is made from high-speed polishing to low-speed polishing when the threshold value is reached, and polishing is terminated when a polishing termination point is detected. The polishing of the wafer 11 in this way is repeatedly performed until the polishing pad 13 is worn, the polishing pad 13 is dressed by the dresser 17 as necessary, and the threshold value is reset in each instance.

As described above, in accordance with the present embodiment, the thickness of the tungsten film can be measured with greater accuracy and the switching timing of polishing conditions can be determined with a high degree of precision because the threshold value for determining the switching timing of polishing conditions is varied in accordance with changes in the thickness due to dressing the polishing pad 13. Therefore, the thickness of the remaining tungsten film can be kept constant even if the thickness of the polishing pad 13 changes, and the throughput of the CMP steps, and erosion and other quality concerns can be made consistent.

The present invention has thus been shown and described with reference to specific embodiments. However, it should be noted that the present invention is in no way limited to the details of the described arrangements but changes and modifications may be made without departing from the scope of the appended claims.

For example, in the above embodiment, the eddy current sensor is used as a sensor for measuring the thickness of the film being polished on the wafer, but the present invention is not limited to an eddy current sensor, and various other sensors can be used.

Also, the film being polished is not limited to tungsten, and copper (Cu), titanium nitride (TiN), and various other metals and metal compounds can be used as the target.

What is claimed is:

1. A CMP apparatus for polishing a film on a wafer, comprising:

a polishing pad;

a film thickness sensor for measuring a thickness of the film via the polishing pad;

a polishing pad thickness measuring unit for measuring a thickness of the polishing pad;

a dresser for dressing the polishing pad; and a polishing control unit for switching polishing conditions in response to a fact that an output value from the film thickness sensor has exceeded a threshold value, wherein the polishing control unit has a memory unit for storing the threshold value corresponding to the thickness of the polishing pad after dressing when the polishing pad is dressed.

2. The CMP apparatus as claimed in claim 1, wherein the memory unit further store conversion information that shows the relationship between the output value of the film thickness sensor and the thickness of the polishing pad when the thickness of the film being polished is constant, and the polishing control unit accesses the conversion information, obtains the output value of the film thickness sensor that corresponds to the thickness of the polishing pad after dressing, and records the output value as the threshold value.

3. The CMP apparatus as claimed in claim 1, wherein the polishing pad thickness measuring unit includes a pad probe.

4. The CMP apparatus as claimed in claim 1, wherein the film thickness sensor includes an eddy current sensor.

5. The CMP apparatus as claimed in claim 1, wherein the polishing target is a metal film or a metal compound film.

6. A wafer polishing method using CMP, comprising:

a polishing pad dressing step for dressing a polishing pad;

a threshold value recording step for recording a threshold value that has been corrected based on a thickness of the polishing pad after dressing;

a high-speed polishing step for performing high-speed polishing of a wafer while a thickness of a film being polished is monitored using a film thickness sensor;

a polishing condition switching step for switching from high-speed polishing to low-speed polishing when an output of the film thickness sensor reaches the threshold value; and a low-speed polishing step for performing low-speed polishing of the wafer as far as the polishing terminal point.

7. The wafer polishing method as claimed in claim 6, wherein the threshold value recording step includes a step for accessing conversion information that shows a relationship between the output value of the film thickness sensor and the thickness of the polishing pad when the thickness of the film being polished is constant, and obtaining the output value of the film thickness sensor that corresponds to the thickness of the polishing pad after dressing; and a step for recording the output value as the threshold value.

8. A wafer polishing method using CMP, comprising:

performing a first polishing of a wafer by using a polishing pad; and switching from the first polishing to a second polishing of the wafer when a measured parameter exceeds a threshold value that corresponds to a thickness of the polishing pad.

9. The wafer polishing method as claimed in claim 8, wherein the first polishing is high-speed polishing and the second polishing is low-speed polishing.

10. The wafer polishing method as claimed in claim 8, further comprising performing the second polishing of the wafer as far as a polishing terminal point.

11. The wafer polishing method as claimed in claim 8, further comprising dressing the polishing pad.

12. The wafer polishing method as claimed in claim 11, further comprising recording the threshold value after dressing the polishing pad.

13. The wafer polishing method as claimed in claim 8, wherein the measured parameter is produced by measuring a thickness of a layer on the wafer using a film thickness sensor while the wafer is being polished.

14. The wafer polishing method as claimed in claim 13, further comprising:

obtaining a corrected output value of the film thickness sensor that corresponds to the thickness of the polishing pad after dressing the polishing pad, the corrected output value being referred to a relationship between an initial value of the film thickness sensor and the thickness of the polishing pad; and recording the output value as the threshold value.

15. A wafer polishing method using CMP, comprising:

dressing a polishing pad; and performing a polishing of a wafer by using the polishing pad, the polishing being continued until a measured parameter indicative of a thickness of the polishing pad after the dressing is not exceeded.

16. The wafer polishing method as claimed in claim 15, wherein performing the polishing of the wafer comprises monitoring a thickness of the wafer by a film thickness sensor while the wafer being polished.

17. The wafer polishing method as claimed in claim 16, wherein performing the polishing of the wafer comprises switching from a first polishing of the wafer to a second polishing of the wafer when an output of the film thickness sensor reaches the threshold value.

18. The wafer polishing method as claimed in claim 17, wherein the first polishing is high-speed polishing and the second polishing is low-speed polishing.

19. The wafer polishing method as claimed in claim 17, further comprising performing the second polishing of the wafer as far as a polishing terminal point.

20. The wafer polishing method as claimed in claim 17, further comprising:

obtaining a corrected output value of the film thickness sensor that corresponds to the thickness of the polishing pad after dressing the polishing pad, the corrected output value being referred to a relationship between an initial value of the film thickness sensor and the thickness of the polishing pad; and recording the output value as the threshold value.

* * * * *